US008715482B2

(12) United States Patent
Amendola et al.

(10) Patent No.: US 8,715,482 B2
(45) Date of Patent: May 6, 2014

(54) ELECTROLYTIC PRODUCTION OF LITHIUM METAL

(75) Inventors: Steven C. Amendola, Easton, PA (US); Lawrence Swonger, Lititz, PA (US); Stefanie Goldman, East Brunswick, NJ (US)

(73) Assignee: RESC Investment LLC, Easton, PA (US)

( * ) Notice: Subject to any disclaimer, the term of this patent is extended or adjusted under 35 U.S.C. 154(b) by 148 days.

(21) Appl. No.: 13/172,401

(22) Filed: Jun. 29, 2011

(65) Prior Publication Data

US 2012/0006690 A1 Jan. 12, 2012

Related U.S. Application Data

(60) Provisional application No. 61/360,341, filed on Jun. 30, 2010.

(51) Int. Cl.
*C25C 1/04* (2006.01)
*C25C 7/08* (2006.01)

(52) U.S. Cl.
CPC .... *C25C 7/08* (2013.01); *C25C 1/04* (2013.01)
USPC ..... 205/560; 205/558; 204/250; 75/391

(58) Field of Classification Search
USPC ..... 75/391
See application file for complete search history.

(56) References Cited

U.S. PATENT DOCUMENTS

| | | | | |
|---|---|---|---|---|
| 4,156,635 | A * | 5/1979 | Cooper et al. | 205/407 |
| 4,455,202 | A | 6/1984 | Sintim-Damoa et al. | |
| 5,131,988 | A | 7/1992 | Peterson | |
| 6,287,448 | B1 * | 9/2001 | Schierle-Arndt et al. | 205/560 |
| 6,770,187 | B1 | 8/2004 | Putter et al. | |
| 2004/0178080 | A1 | 9/2004 | Thompson et al. | |
| 2006/0171869 | A1 * | 8/2006 | Anovitz et al. | 423/179.5 |
| 2009/0090638 | A1 * | 4/2009 | Kelly et al. | 205/406 |

OTHER PUBLICATIONS

International Search Report and Written Opinion for PCT/US2011/042383, dated Nov. 14, 2011.

* cited by examiner

*Primary Examiner* — Harry D Wilkins, III
(74) *Attorney, Agent, or Firm* — Baker Botts L.L.P.

(57) ABSTRACT

The present invention provides a process for preparing lithium alloy or lithium metal from lithium carbonate or its equivalent lithium ion source such as spudomene ore without creating toxic byproducts such as halogen gases and a system adopted for such a process.

5 Claims, 7 Drawing Sheets

ELECTROLYTIC PRODUCTION OF LITHIUM METAL

RELATED APPLICATION

This application claims priority to U.S. Provisional Application Ser. No. 61/360,341 filed on Jun. 30, 2010, the disclosure of which is incorporated herein by reference in its entirety.

BACKGROUND OF THE INVENTION

Alkali metals are made from molten salts of the metal in electrolytic cells. This method of making alkali metals has remained largely unchanged for a century. Although some carbothermic-based processes have been proposed, ultimately such processes have been proven to be less economical than the molten salt electrolysis method. The very high activity of these metals usually requires an electrolytic method. Alkali metals are known to be able to be made as amalgams from aqueous systems using mercury as a cathode. However, mercury has the potential to cause severe environmental harm, thus its use has been banned or strictly limited in most developed countries.

Even though the production of alkali amalgams for recovering alkali metals is mentioned in U.S. Pat. No. 2,990,276, U.S. Pat. No. 4,156,635, U.S. Pat. No. 4,455,202, U.S. Pat. No. 4,988,417, U.S. Pat. No. 2,145,404, U.S. Pat. No. 2,234,967, and U.S. Pat. No. 4,156,635, none of these patents teaches the proper combination of chemistry [and alloys so as to create a process that is more economical than the molten salts systems that need to be replaced.

The molten salts systems themselves require difficult conditions, such as the heating of electrically-conductive crucibles (usually made of graphite) to temperatures above that of the molten salt being used, electrolyzing the salt, and collecting the molten alkali metal.

Lithium was first discovered in the early 1800s, via electrolysis of a high-temperature molten salt. Today, lithium is industrially produced in essentially the same way. Major improvements that have been made over the past two hundred years mostly relate to the selection of different types of molten salts that are used as the electrolyte. Careful combinations of the salts have allowed for a decrease in operating temperatures (still several hundred degrees Celsius), and thereby enhanced system stability and lowered operating costs. In the intervening historical period, a low temperature, water based technology was also developed. This process derived from the electrolysis of brine to form chlorine at an anode and sodium hydroxide or potassium hydroxide via a series of cathode related reactions. The formation of either of these hydroxides involves the reduction of the alkali cation to metal at a liquid mercury cathode, followed by reaction of the mercury amalgam so formed with water. This process operates near room temperature and at a lower voltage than is required for molten salt systems. It has long been known that lithium chloride in water will undergo the same chemistry, producing a Hg(Li) amalgam and chlorine gas. It is also well known that other water soluble salts of lithium will also generate this amalgam, but that the anode product will change depending on the anion present in the original lithium compound. Thus, for example, if lithium hydroxide (LiOH) is used as the starting material, oxygen will be formed at the anode.

The Hg(Li) amalgam, once electrochemically formed, will yield pure lithium metal if it is removed from the water electrolyte while still under potential control and then either extracted with an agent, such as an amine, and distilled. While such an approach might produce electrolytic lithium more cost-effectively than the molten electrolyte methods, it would generate unacceptable environmental problems. For example, day-to-day operations would require large amounts of mercury, which, in the event of a mechanical failure of the containment vessel, could leak from a cell and contaminate the environment."

In order to circumvent these problematic issues, the present invention removes the mercury electrode in the above process and replaces it with a liquid metal alloy electrode. Like mercury, the alloy would be selected so that it had both a high hydrogen over-potential and good chemical kinetics for amalgamation with lithium. However, in contrast to mercury, the proposed metal systems would be solid at room temperature, melting at relatively low temperatures (ideally, at no more than slightly above 100° C., where the water based electrolyte would boil), and would not be highly toxic. Several alloys of bismuth, lead, tin, and indium meet these requirements.

U.S. Pat. No. 4,455,202 (Electrolytic Production of Lithium Metal) Jun. 19, 1984 uses a similar liquid metal cathode in relation to a fused salt electrolyte, which still requires high temperatures, i.e., several hundred degrees Celsius. U.S. Pat. No. 6,730,210 discloses a low temperature alkali metal electrolysis process in the presence of a co-electrolyte and an alkali metal halide. However, in the latter case, the electrolysis process has several problems. First of all, the process requires highly toxic acid and produces a highly toxic halogen gas as a side product both of which are environmentally unfriendly. Second, the solubility's of lithium halides in water are somewhat limited, thus the electrolysis efficiency is not high.

Accordingly, the present invention provides a process and system for the extraction of lithium from lithium carbonate or its equivalent lithium ion source at much lower temperatures using a far more environmentally friendly process.

DETAILED DESCRIPTION OF PREFERRED EMBODIMENTS OF THE INVENTION

Figure 1:
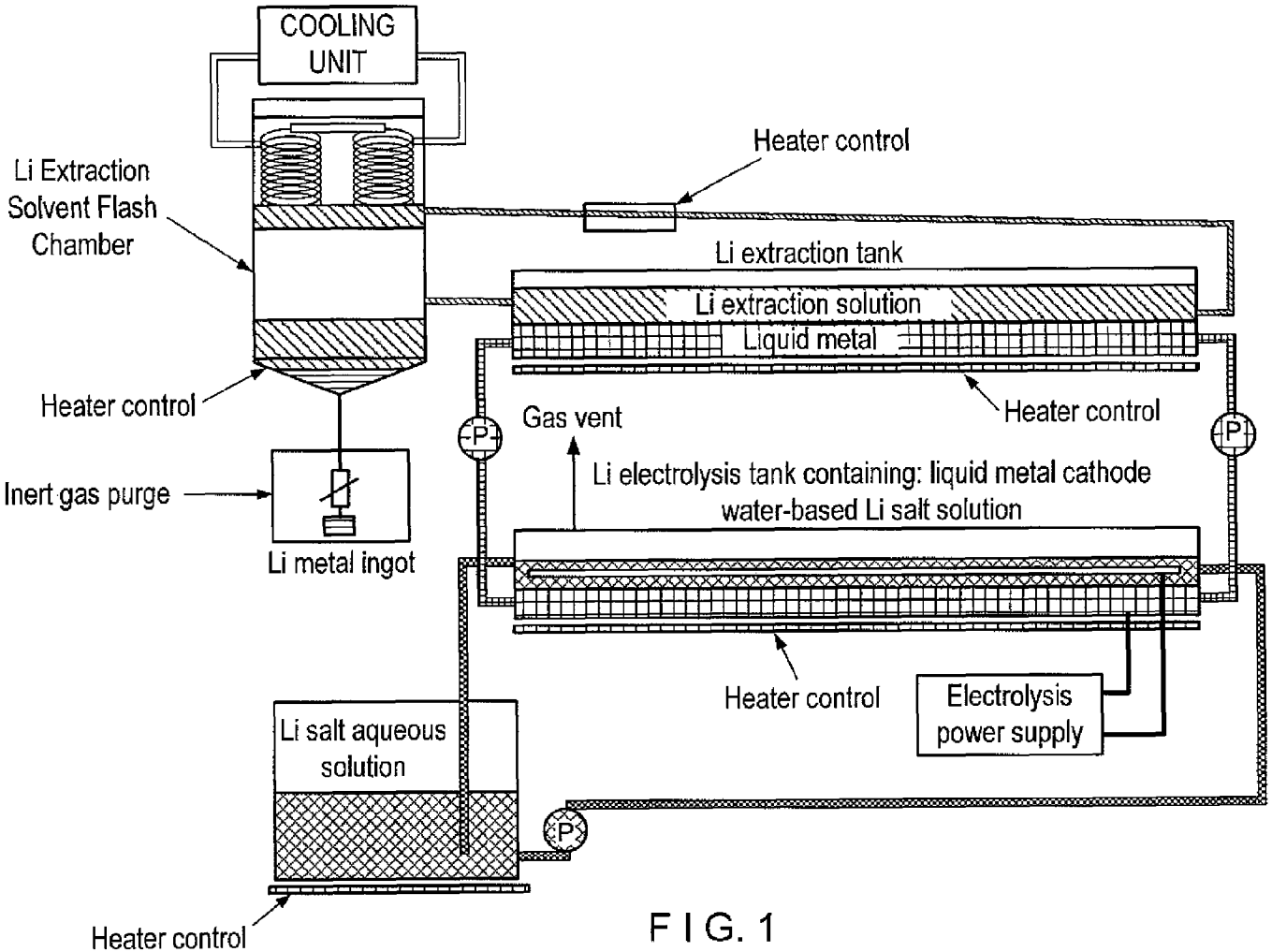
FIG. 1. A simplified example of a continuous process according to an embodiment of the present invention.

According to one embodiment of the invention, the process could be used to produce a solidified Li-rich metal alloy which could be stored for later processing, or could be used as part of a continuous Lithium metal production process. In particular, the present process utilizes lithium carbonate or an equivalent source of lithium carbonate, which is one of the least expensive sources and one that does not produce any toxic gas such as halogen gas. In addition, the present process can be used to produce lithium directly from spudomene ore or other natural lithium sources without generating a lithium halide.

In one embodiment, the process produces lithium from lithium carbonate through steps including providing lithium carbonate or its equivalent source of lithium carbonate and at least an acid selected from sulfuric acid, trifluoromethane sulfonic acid, fluorosulfonic acid, trifluoroboric acid, trifluoroactetic acid, trifluorosilicic acid and kinetically hindered acids in an aqueous solvent wherein lithium ion is dissolved in the solvent forming a lithium feed solution, providing an anode in contact with the solution, providing a liquid metal cathode suitable for electrolysis of lithium, wherein the liquid metal cathode is in contact with the solution and forms an electrolysis cell, providing electric current to the electrolysis cell, thereby producing lithium at the liquid metal cathode, forming an alloy with the liquid metal cathode, and optionally isolating lithium from the liquid metal cathode.

In another embodiment, the invention provides a process for producing lithium which comprises an electrolysis of lithium ion in an electrolytic cell comprising a liquid metal cathode and an aqueous solution, wherein the aqueous solution containing lithium ion and an anion selected from sulfate, trifluoroborate, trifluoroactetate, trifluoro silicate, and a kinetically hindered acid anion and wherein the lithium ion is produced from lithium carbonate.

In another embodiment, the invention provides a process for producing lithium directly from natural lithium sources such as spudomene ore, sea water, etc., without generating a lithium halide, where the process includes an electrolysis of lithium ion in an electrolytic cell comprising a liquid metal cathode and an aqueous solution, wherein the aqueous solution containing lithium ion wherein the lithium ion is produced by reacting spudomene ore with an acid selected from sulfuric acid, trifluoroboric acid, trifluoroactetic acid, trifluorosilicic acid and a kinetically hindered acid or is obtained from sea water or other aqueous solutions.

Yet another embodiment provides a process for producing lithium, which process comprises an electrolysis of lithium ion in an electrolytic cell comprising a liquid metal cathode and an aqueous solution, wherein the aqueous solution containing lithium ion and an anion, wherein the anion causes a parasitic current loss less than 50%, preferably 40%, more preferably 30%, and even more preferably 20%.

The invention also provides another embodiment that relates to a lithium production system utilizing electrolysis of lithium ion, which includes an electrolytic cell comprising a liquid metal cathode and an aqueous solution, wherein the aqueous solution containing lithium ion and an anion selected from sulfate, trifluoroborate, trifluoroactetate, trifluorosilicate, and a kinetically hindered acid anion and wherein the lithium ion is produced from lithium carbonate; a heating system maintaining the temperature of the cell and liquid metal circulating systems higher than the melting point of the liquid metal cathode but lower than the boiling point of the aqueous solution; and an extraction cell, wherein the reduced lithium from the electrolytic cell is extracted from the liquid metal cathode using a suitable extraction solution, and a distillation system for isolating the lithium metal from the extraction solution.

When choosing a proper anion for the lithium salt in the aqueous solution, it is important to consider whether the anion being selected would be electroactive at the conditions that the system will run at. If the anion of the lithium salt is electroactive, then the operator will encounter parasitic losses in the system. Energy that is put into the system for the purpose of reducing the lithium cation into lithium would instead be used to reduce the anion or other chemicals present in the system. For example, bromide or iodide anions would be reduced at the anode, forming bromine and iodine. Such a bi-reaction is undesirable, as it wastes the energy and produces environmentally unfriendly byproducts. Also, lithium hydroxide would not be a suitable lithium salt for use in the invention because the presence of the hydroxide ion facilitates a water electrolysis reaction. The lithium hydroxide salt undergoes electroreduction, and the energy input into the system splits water instead of converting the lithium cation into lithium metal. The hydroxide ion catalyzes the formation of oxygen at the anode, allowing the system as a whole to split water more easily.

Unlike lithium halides or lithium hydroxide, lithium carbonate ($Li_2CO_3$) does not have problems as described above. Moreover, lithium carbonate is very inexpensive. However, $Li_2CO_3$ has a very low solubility in water. In order to perform direct electrolysis of aqueous $Li_2CO_3$, a suitable co-electrolyte must be used which promotes solvation of $Li_2CO_3$ in water. Such a co-electrolyte does not significantly reduce the hydrogen over potential of the electrolytic cell, and does not reduce preferentially to the Lithium in solution.

If the anion isn't catalyzing a parasitic reaction, care must be taken to ensure that the cathode is not reducing the anion along with the lithium cation. Though it would be expected that anions with a lower electrochemical potential than lithium would always be reduced before the lithium cation, this is not necessarily the case. Some anions are kinetically hindered or are otherwise hindered from reduction and the conditions for electrochemical reduction of the anion at the working electrode are not favored. Suitability of an anion can be determined through cyclicvoltametry or other electrochemical measurement. It can be easily determined if the anion is significantly contributing to parasitic loss of energy through such techniques.

Figure 2:
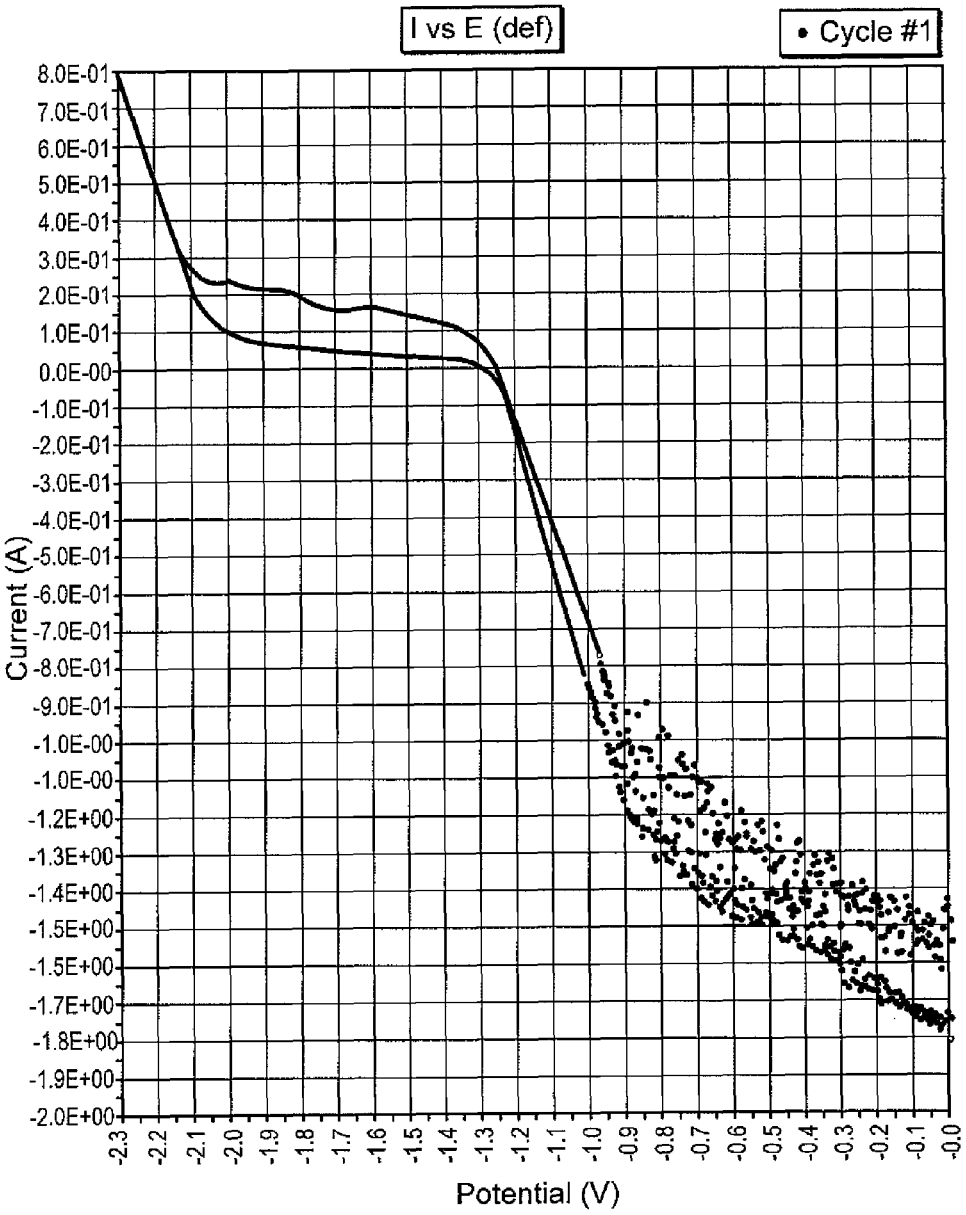
FIG. 2. Cyclic voltammogram of lithium hydroxide.
Figure 3:
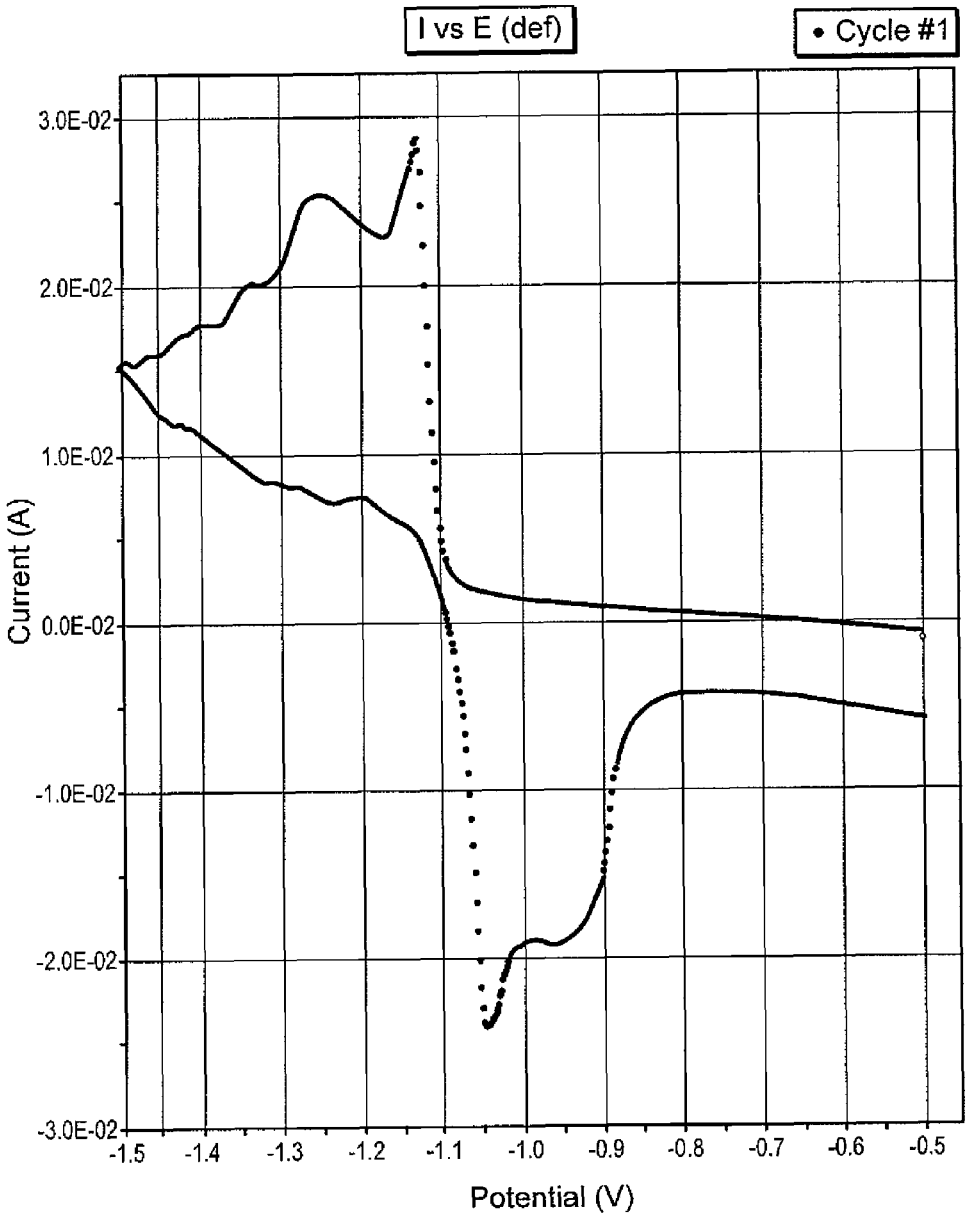
FIG. 3. Cyclic voltammogram of a lithium metaborate solution.
Figure 4:
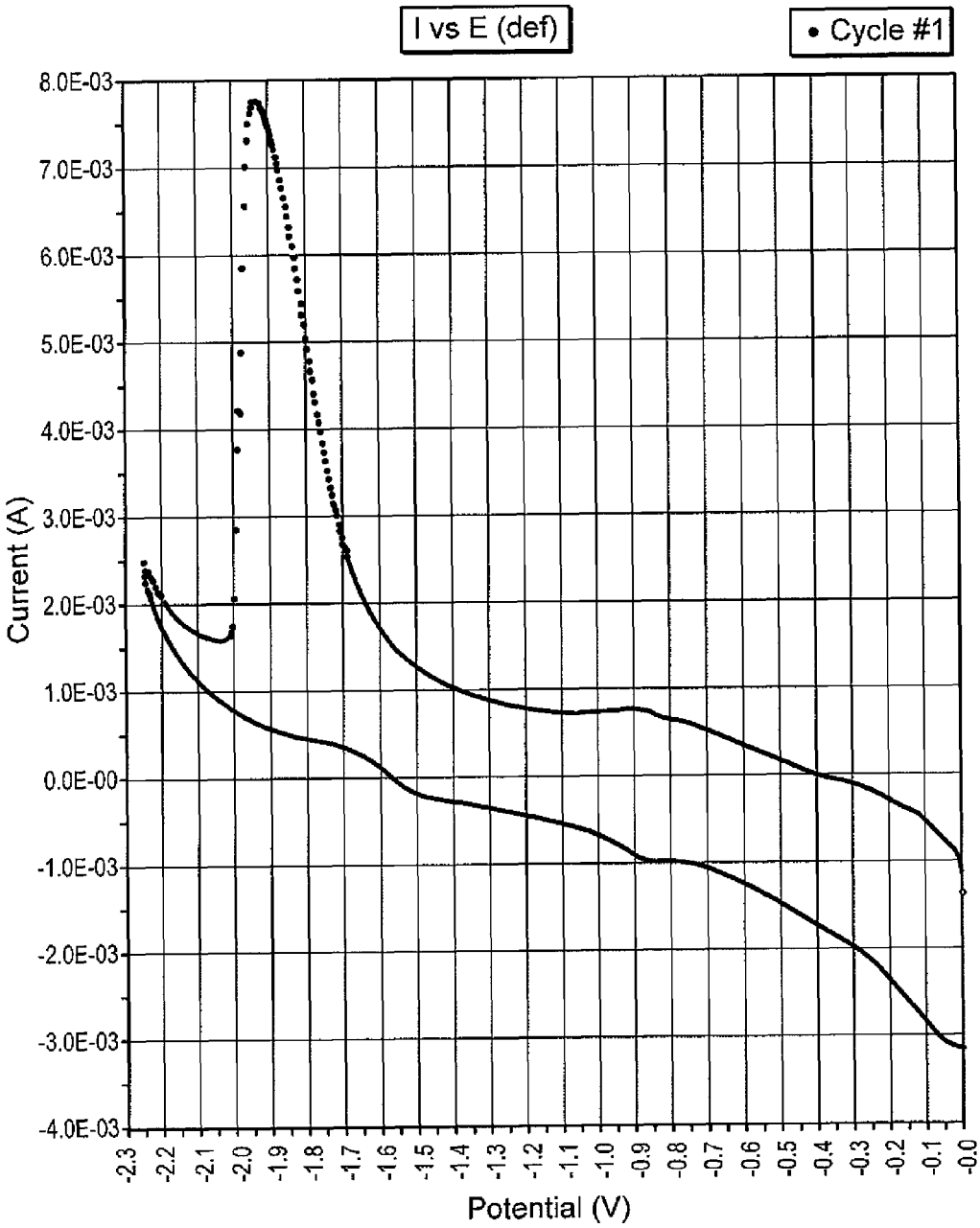
FIG. 4. Cyclic voltammogram of a lithium sulfate solution with a low lithium carbonate concentration.
Figure 5:
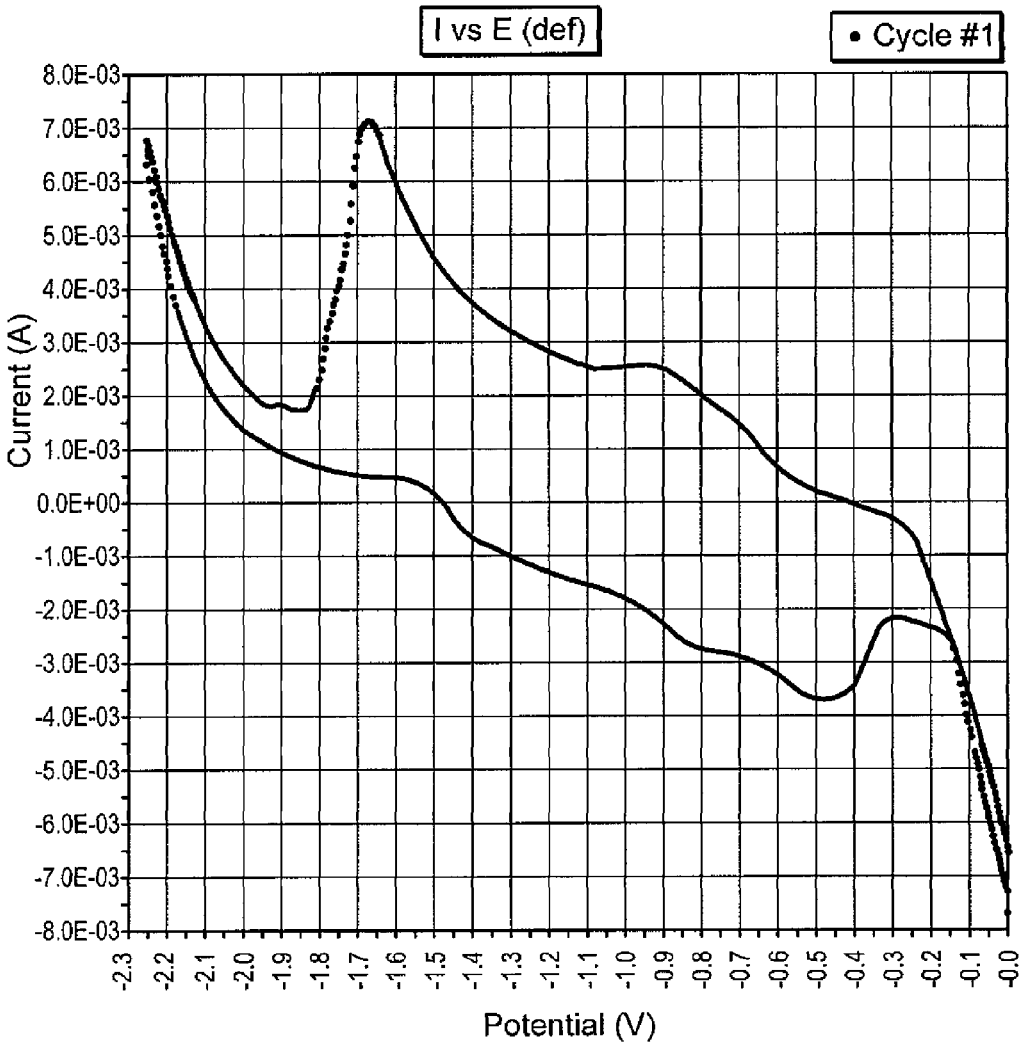
FIG. 5. Cyclic voltammogram of a lithium sulfate solution with an increased lithium carbonate concentration.
Figure 6:
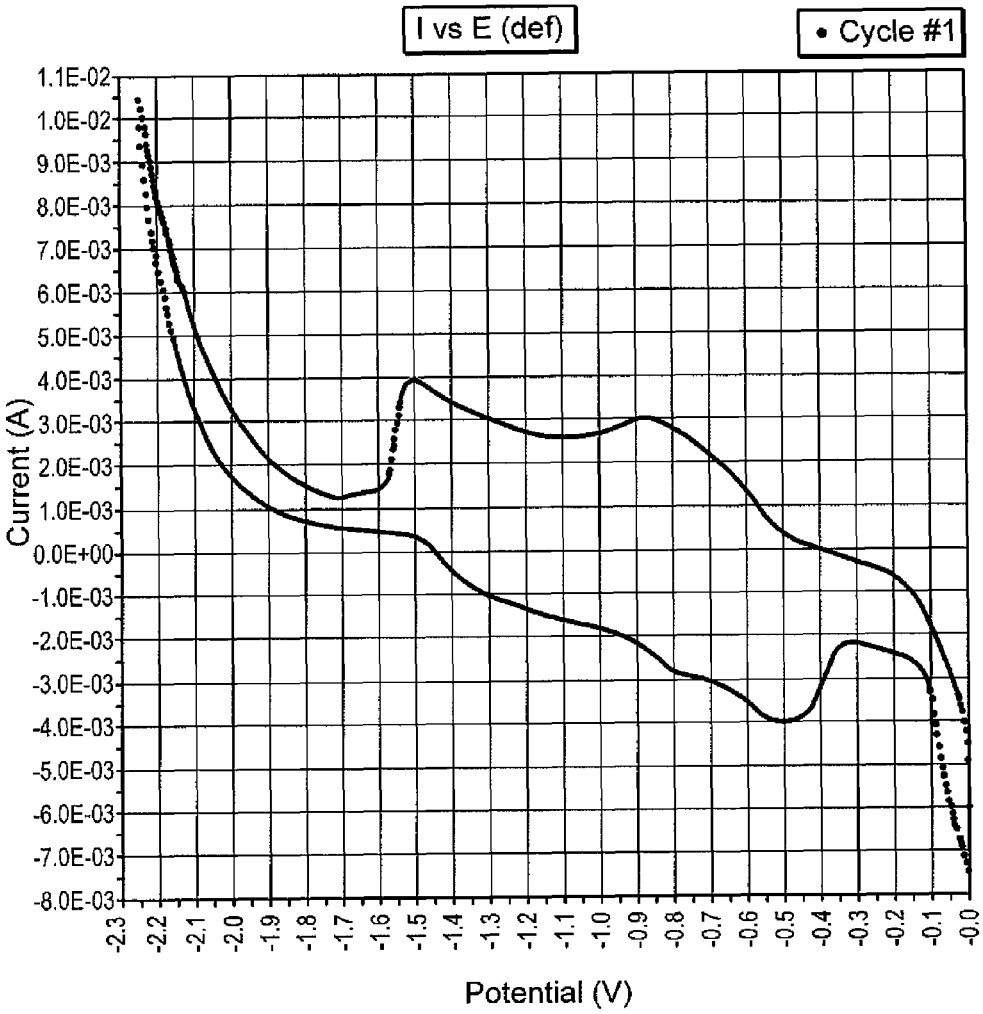
FIG. 6. Cyclic voltammogram of a lithium sulfate solution with an increased lithium carbonate concentration after holding the voltage at 1.7 v for 2 minutes.
Figure 7:
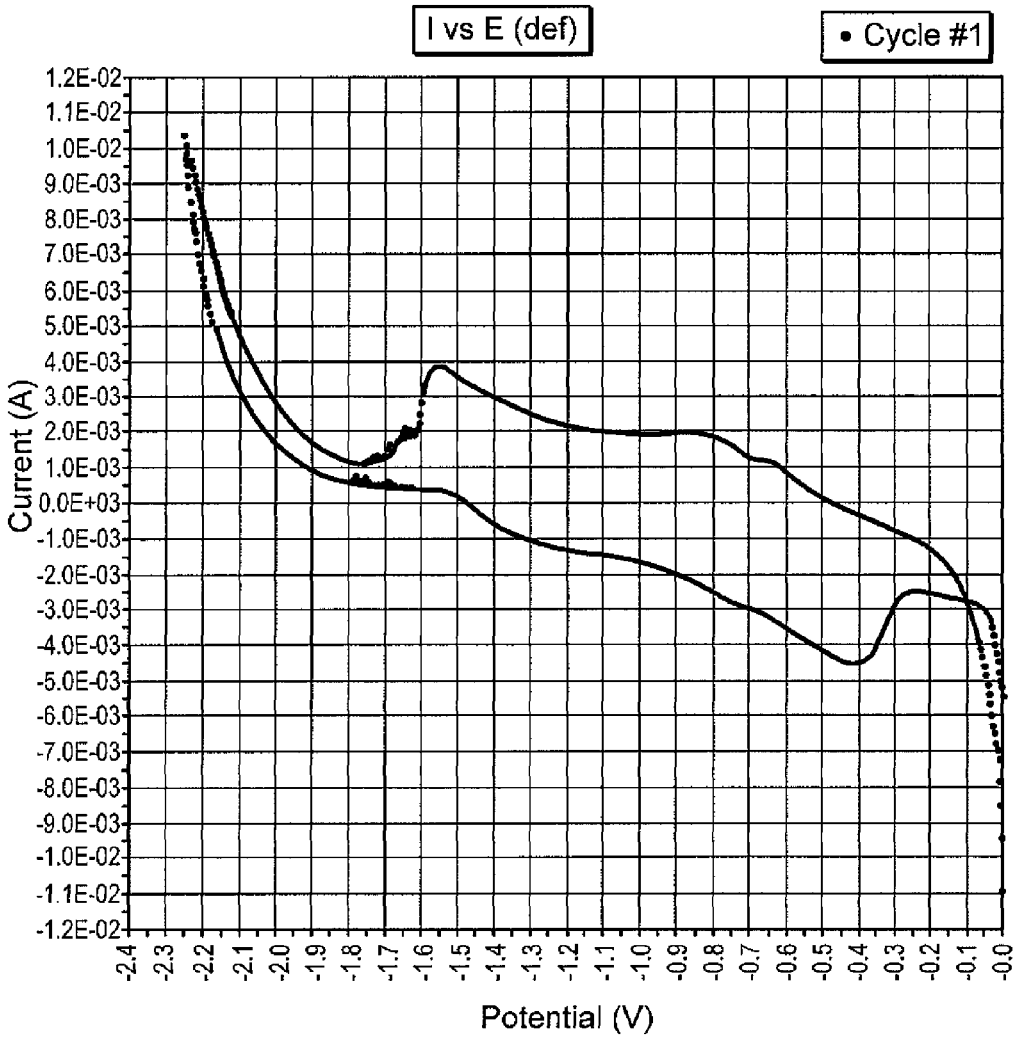
FIG. 7. Cyclic voltammogram of a lithium sulfate solution with an increased lithium carbonate concentration after holding the voltage at 1.7 v for 16 minutes.

The parasitic loss due to electroactivity of the chemical anion or chemical system is illustrated with the cyclic voltammograms (CV) in FIGS. 2-4. FIG. 2 illustrates the reduction of lithium hydroxide. The large step function in the reduction curve beginning at ~−1.3V is the increase in current supplied to the system due to the catalyzed electrolysis of water. This is current that is not being used for the reduction of lithium. FIG. 3 illustrates the electroactivity of a lithium metaborate solution. The figure shows a large increase in current supplied to the system at ~−1.1V and again at ~−1.25V (the two peaks in the figure) before the current decreases again. This indicates that the metaborate anion undergoes multiple electrochemical reductions in this system and is not suitable as a counter anion for the lithium cation. FIG. 4 illustrates the electroactivity of a lithium sulfate solution showing just the one reduction peak at ~−1.9V. This system illustrates a rather simple electrochemical system and is more suited for the reduction of the lithium cation than the other two lithium salts.

Thus, for the purpose of the present invention, lithium salts that have cyclic voltammograms similar to FIG. 3 where there is no significant reduction current before reaching the reduction potential of the lithium salt are suitable. The acceptable level of any parasitic current losses is determined by the economics of how such a system would perform and does not preclude any salt that produces lithium from inclusion under this invention. The level of the parasitic current losses are less than 50%, preferably 40%, even more preferably 30%, and even more preferably 20%.

The parasitic current losses are not completely wasted in the present invention because the side products of the parasitic reduction are hydrogen and oxygen, which also have commercial value. Accordingly, one aspect of the present invention includes the production of hydrogen and oxygen while making lithium.

The pH of the aqueous lithium salt solution should be maintained moderately acidic or neutral, preferably between about 7-3, more preferably about 7-4, and even more preferably 7-5. Anions that shift the pH of the lithium salt solution greatly to an extreme pH, e.g., either a very high pH or a very low pH, will catalyze the electrolysis of water, which ends up being a parasitic loss to the system.

Basic subsystems required to produce lithium metal from the lithium salt feed material may include an electrolytic cell used to move lithium metal from a water-based lithium salt solution into a liquid metal cathode, then either solidifying the lithium containing metal alloy while still under potential, or removing it from contact with the water-based electrolyte while still under potential, a lithium extraction cell used to move lithium metal from the lithium containing amalgam into an extraction solution, and a flash tank or other system used to flash off the extraction solution leaving lithium metal behind.

The liquid metal cathode is a low melt temperature alloy with both a high hydrogen over potential and good chemical kinetics for amalgamation with lithium. Suitable liquid metal cathode materials include alloys of Bismuth, Lead, Tin, and Indium, which have a melting point from as low as 58° C. (136° F.) up to 95° C. (203° F.).

Suitable feed materials are water-soluble lithium salts including but not limited to LiCl, LiF, and $Li_2CO_3$, which will dissolve in most mineral acids. For LiCl, a DSA type electrode is required to avoid generation of a toxic chlorine gas. Lithium fluoride or chloride is not as environmentally friendly or as economical as lithium carbonate. Thus, $Li_2CO_3$ or any equivalent source thereof is preferred.

The present invention may adopt spudomene directly. For example, finely ground spudomene ore concentrate may be heated to 1075-1000° C., changing its molecular structure and making it more reactive to sulfuric acid. A mixture of the finely ground converted spudomene may then be added to sulfuric acid and heated to 250° C., producing lithium sulfate. Water is then added to dissolve the lithium sulfate and the resulting solution can be used as the feed stock for the electrolysis of the present invention. Depending on the level of purity of the lithium sulfate solution, the solution can be further purified as necessary.

The invention uses specific alloys chosen for a combination of having a low melting point, e.g., less than 125° C., having a high hydrogen over potential, and having an affinity for lithium. A combination of all of these allows for the production of lithium metals at a lower cost which heretofore had not been accomplished. Additionally, better methods of recovering the alkali metals from the alloy are also required.

The first step is the electrolysis of the lithium salt in a cell. The salt solution is made and sent to the cell. There are many water soluble salts of lithium, including, but not limited to, lithium salts of the following anions: acetate, nitrate, sulfate, hydroxide, per chlorate, fluorosulfonate, trifluoromethane sulfonate, fluorosilicate, chloride, chlorate, iodate. However, some of them have the advantage of being difficult to oxidize their anions, thus oxygen rather than, for instance, a halogen, will be released from the anode. Lithium fluoride and lithium carbonate have lower water solubility, and thus has been considered less preferred. However, in the present invention, an additive is employed to the solution so as to enhance the solubility of the salt and also would improve the cell's performance.

In addition to the above anions, fluoride and carbonate would be suitable for sodium production, as they have significantly higher water solubility.

An alloy is chosen that is liquid at below the boiling point of the solution. While water boils at 100° C., the salt solution's boiling point increases about 0.5° C. per mole/liter of ions in the solution. Thus, some concentrated solutions could have a boiling point several degrees above 100° C. This could allow for the use of some alloys with melting points in this range. Some examples of such alloys are as follows: (from high to low m.p.):

TABLE 1

| Alloy Composition (weight %) | Melting Point (° C.) |
|---|---|
| 50 Bi 28 Pb 22 Sn | 109 |
| 50 Bi 20 Sn 30 Pb | 100 |
| 50 Bi 25 Sn 25 Pb | 98 |
| 50 Bi 18.8 Sn 31.2 Pb | 97 |
| 52.5 Bi 32 Pb 15.5 Sn | 95 |
| 67 In 33 Bi | 70 |
| 51 In 32.5 Bi 6.5 Sn | 60.5 |
| 49.5 Bi 7.6 Pb 11.6 Sn 21.3 In | 58.2 |
| 100 Ga | 29.78 |
| 82 Ga 12 Sn 6 Zn | 17 |
| 69.8 Ga 17.6 In 12.5 Sn | 10.8 |
| 62.5 Ga 21.5 In 16 Sn | 10.7 |

It is understood that many alloys not listed in Table 1 also may be useful and that the above list is not limiting. While there are many other alloys, some of possible example elements include bismuth, tin, lead, indium zinc and gallium. There are also many alloys that contain cadmium, such as Wood's metal, with a melting point of 70° C. However, cadmium has also an environmental problem. Selection of the alloy would also depend on which recovery method is used. For example, if distillation is used, then the boiling points of the metals should be considered more. Cadmium and zinc have boiling points about that of most alkali metals and would not be useful as a component of the alloy. However, if chemical extraction is used, then zinc is acceptable.

As for cost in general, lead, zinc, tin, and bismuth are the cheapest metals and thus the first 5 listed alloys are the most economical.

Indium is moderately expensive and gallium is very expensive. Thus, these materials would not be desirable in terms of cost but may be desirable for other reasons.

The alloy is placed in the bottom of a cell and an anode made of a suitable material not to be corroded by the anodic or chemical action is chosen to oppose the alloy anode. The salt solution is placed in the cell and the whole is heated up to above the melting point of the alloy. Once the alloy melts, the current may be applied and the reaction starts. The alloy will start to incorporate the alkali metal as the electrolysis proceeds. If a salt is chosen so that oxygen is evolved, it may be collected for sale or use.

At the cathode the reaction is:

$$e^- + Li^+ \rightarrow Li(alloy) \quad (1)$$

At the anode the reaction for oxygen evolution is $$2OH^- \rightarrow H_2O + \tfrac{1}{2}O_2 + 2e^- \quad (2)$$

Thus, the pH will drop unless the system is replenished by more base. In the present invention, this problem does not exist because lithium carbonate is used as the lithium source wherein carbonate acts as a base supply as follows:

$$CO_3^{2-} + H_2O \rightarrow CO_2 + 2OH^-$$

In as much as the temperature may be near the boiling point of water, provision should be made to either condense the water vapor coming off the cells and allow it to return to the cells and/or for additional water that may need to be occasionally added to the cell to maintain the electrolyte level. It should be noted that running the electrolysis at temperatures near 100° C. will reduce the necessary voltage to drive the reaction and thus will save energy.

When sufficient product has built up in the alloy, it may be removed (by any means but a pump would be the easiest) and replenished with fresh alloy from the extractor. The alloy is pumped to the extractor where the alkali metal is removed.

The extraction can be performed either through a distillation process or a chemical process. If a distillation process is used, all of the alloy components should have high boiling points. Thus, metals with low boiling points such as zinc or cadmium may not be in the alloy. Lithium boils at 1367° C. and would be the hardest to recover. However, by using a vacuum distillation, this temperature can be lowered considerably by running at less than 1 torr. The other alkali metals boil below 800° C. but would still benefit from a vacuum distillation as well.

In general, chemical extraction is less costly. Anhydrous organic amines dissolve the alkali metals. For example, pentyl amine, pyridine, HMPO, isopropylamine, triethylamine, triethyltetramine, ethylenediamine or anhydrous ammonia can dissolve the alkali metals. In the case of ammonia, it would have to be done at pressure since the alloy should still be molten for the extraction. Thus, the solvent should be chosen to have a boiling point greater than the melting point of the alloy or to allow for pressurization of the vessel if this criteria is not met.

This extraction can be sped up if desired by making the alloy an anode in another cell and adding a compound (or using a solvent) that can be reduced. This, however, adds to the cost and energy consumption of the process.

When the solvent with the alkali metal is ready for processing, it is placed in a simple still (e.g., a vacuum still) and solvent is simply distilled off, leaving behind a high purity alkali metal. The solvent is returned to the extractor for reuse.

The process and system can use either a batch process or a continuous process. In a batch process, the electrolysis would be performed to bring the lithium content of the liquid metal cathode up to a predetermined concentration, at which time the liquid metal cathode would be cooled down and solidified (while still under potential). The solidified cathode would be stored or moved into the extraction system. In a continuous processing system, the liquid metal cathode would circulate between the electrolysis tank and the extraction system, continually picking up lithium in the electrolysis tank and giving it up into the extraction solution in the extraction tank.

Lithium metal produced by this process could be used for a variety of applications, including, but not limited to, button Cell batteries, medical lithium, metallurgy products, lithium air batteries, and so on.

The lithium production process of the present invention can be conducted in a continuous closed system or in a batch system. FIG. 1 shows an exemplary simplified system for the process of the present invention.

EXAMPLE

Sulfuric acid solution was made up using 7500 ml of Di water and pH of the solution was 0-1 per pH strips. Lithium carbonate was slowly added to the sulfuric acid solution until the solution was saturated and the pH had risen to approximately 7+ per pH strips. The system was run at 1.7-1.9 vdc with a current draw of 0.1-0.15 amp. A layer of sediment slowly developed on the liquid metal cathode. The electrolyte also became cloudy and an "off" smell was noted in the feed tank. After 3 hours of run time, more acid was added to the feed tank, taking pH to ~2 in the feed tank. There was a release of $CO_2$ in the feed tank, as well as from the sediment on the liquid metal cathode. After approximately 20 minutes, all of the sediment had dissolved, leaving the cathode that is bright and shiny, and the electrolyte that is clear. The pH of the feed tank was about 3. Amperage was 0.2 A at 1.7 v. Another 2500 ml of solution was mixed up and added to the feed tank, except this solution started off with much more sulfuric acid and lithium carbonate, and lithium carbonate addition was stopped when the pH rose to approximately 3. The system was then run at 1.9-1.95 vdc for 6 hours, with a starting current draw of 0.45 amp, which was then decreased steadily to 0.30 amp after 6 hours. At 2.0 vdc and above, noticeable hydrogen production began (amperage increase and rise on hydrogen detector), so voltage was kept below this level. The pH of the solution remained steady at 3, or may have slightly decreased to the 2-3 range per pH strips. After 6 hours of run time, the liquid metal cathode was pumped up into the extraction tank (which is under argon purge) and the return flow to the electrolysis tank was stopped (trapping the liquid metal in the extraction tank). Samples of the extraction solution and liquid metal were retrieved from the extraction tank before the liquid metal cooled. Amperage was 0.30 A at 1.9 v just prior to stopping the run. Voltage in the electrolysis tank was held until the small amount of remaining liquid metal had solidified. A voltage of 1.51 vdc was noted in the tank after potential was removed. 1.37 vdc after 1 minute, 1.34 vdc after 2 minutes.

Those skilled in the art will readily observe that numerous modifications and alterations of the process and system may be made while retaining the teachings of the invention. For example, the present invention is primarily described with respect to preparation of lithium but the similar chemistry may be used to produce other alkali metals.

What is claimed is:

1. A process for producing lithium from lithium carbonate which comprises:

a. Providing lithium carbonate and at least an acid selected from sulfuric acid, trifluoromethane sulfonic acid, fluorosulfonic acid, triflouroboric acid, trifluoroactetic acid, trifluorosilicic acid and kinetically hindered acids in an aqueous solvent wherein lithium anion is dissolved in the solvent forming a lithium feed solution;

b. Providing an anode in contact with the solution;

c. Providing a liquid metal cathode suitable for electrolysis of lithium, wherein the liquid metal cathode is in contact with the solution forms an electrolysis cell;

d. Providing electric current to the electrolysis cell thereby producing lithium at the liquid metal cathode, forming an alloy with the liquid metal cathode;

e. isolating lithium metal from the liquid metal cathode;

wherein the isolating of lithium is conducted by an extraction process using a suitable extraction solvent.

2. The process of claim 1, wherein the extraction solvent is selected from pentyl amine, pyridine, HMPO, isopropylamine, triethylamine, triethyltetramine, ethylenediamine or anhydrous ammonia.

3. The process of claim 2, wherein the extraction is conducted under pressure.

4. A lithium production system utilizing electrolysis of lithium ion, which comprises a. an electrolytic cell comprising a liquid metal cathode and an aqueous solution wherein the aqueous solution containing lithium ion and at least an anion selected from sulfate, trifluoromethane sulfonate, fluorosulfonate, triflouroborate, trifluoroactete, trifluorosilicate and kinetically hindered acid anions and wherein the lithium ion is produced from lithium carbonate;

b. a heating system maintaining the temperature of the cell and liquid metal circulating systems higher than the melting point of the liquid metal cathode but lower than the boiling point of the aqueous solution; and c. an extraction cell wherein the reduced lithium from the electrolytic cell is extracted from the liquid metal cathode using a suitable extraction solution;

d. a distillation system for isolating the lithium metal from the extraction solution.

5. The lithium production system according to claim 4, wherein the anion is sulfate.

* * * * *